US007393472B2

(12) United States Patent
Lee et al.

(10) Patent No.: US 7,393,472 B2
(45) Date of Patent: Jul. 1, 2008

(54) COMPOSITION FOR COATING ORGANIC ELECTRODE AND METHOD OF MANUFACTURING AN ORGANIC CONDUCTIVE LAYER HAVING EXCELLENT TRANSPARENCY USING THE COMPOSITION

(75) Inventors: Jong-Woo Lee, Seoul (KR); Chul-Hwan Kim, Daejeon (KR); Hyun-Nam Yoon, New Jersey, NJ (US)

(73) Assignee: DPI Solutions, Inc., Daejeon (KR)

( * ) Notice: Subject to any disclaimer, the term of this patent is extended or adjusted under 35 U.S.C. 154(b) by 0 days.

(21) Appl. No.: 10/599,443

(22) PCT Filed: Mar. 15, 2005

(86) PCT No.: PCT/KR2005/000748

§ 371 (c)(1),
(2), (4) Date: Sep. 28, 2006

(87) PCT Pub. No.: WO2005/096319

PCT Pub. Date: Oct. 13, 2005

(65) Prior Publication Data

US 2007/0200099 A1 Aug. 30, 2007

(30) Foreign Application Priority Data

Apr. 1, 2004 (KR) ..... 10-2004-0022656

(51) Int. Cl.
*H01B 1/00* (2006.01)
*H01B 1/12* (2006.01)

(52) U.S. Cl. ..... 252/500; 257/40; 427/393.1; 428/411.1; 438/149; 178/18.06

(58) Field of Classification Search ..... 252/500; 257/40; 438/149; 427/393.1; 428/411.1; 178/18.06
See application file for complete search history.

(56) References Cited

U.S. PATENT DOCUMENTS 4,937,148 A 6/1990 Sato et al.
5,035,926 A * 7/1991 Jonas et al. ..... 427/393.1
5,766,515 A 6/1998 Jonas et al.
6,083,635 A 7/2000 Jonas et al.
6,955,772 B2 * 10/2005 Van den Bogaert ..... 252/500
7,037,767 B2 * 5/2006 Hirai ..... 438/149
2003/0118829 A1 * 6/2003 Hsu ..... 428/411.1
2003/0213624 A1 * 11/2003 Cross et al. ..... 178/18.06
2004/0144975 A1 * 7/2004 Seki et al. ..... 257/40
2006/0006378 A1 * 1/2006 Hirai ..... 257/40

FOREIGN PATENT DOCUMENTS

JP 08-022722 * 1/1996
KR 1020000031306 5/2000

OTHER PUBLICATIONS

Baytron P (Bayer Corporation) Product Data Sheet(s). www.bayer-echemicals.com/request/pages/baytron/p.*
English language abstract of Korean Publication No. 2000-0001824.
English language abstract of Korean Publication No. 2003-0036236.
English language abstract of Korean Publication No. 2004-0011381.

* cited by examiner

*Primary Examiner*—Mark Kopec
*Assistant Examiner*—Khanh T Nguyen
(74) *Attorney, Agent, or Firm*—Marger Johnson & McCollom PC

(57) ABSTRACT

The present invention relates to a composition for coating an organic electrode and method of manufacturing an organic electrode having a excellent transparency using the composition comprising 3% to 20% by weight of a polyhydric alcohol, polyol or a mixture thereof, 5% to 10% by weight of a primary alcohol having C1 to C5, 5% to 25% by weight of a amide, sulfoxide or a mixed solvent thereof, 0.01% to 0.1% by weight of a surfactant and a aqueous solution of polyethylenedioxythiophene (PEDOT) conductive polymers having nano-sized particle in a remainder. The present invention indicates the excellent transparency that transmittance of organic conductive layer is more than 90% in the visible ray area and sheet resistance is 300 to 900 Ω/sq in case of coating. Therefore the present invention is capable of manufacturing the organic electrode such a electrode or a writing material of organic transistor, smart card, antenna, electrode of battery and fuel battery, capacitor using for PCB, inductor, electromagnetic wave cover and a sensor etc. as well as the transparency electrode using for display.

9 Claims, No Drawings

COMPOSITION FOR COATING ORGANIC ELECTRODE AND METHOD OF MANUFACTURING AN ORGANIC CONDUCTIVE LAYER HAVING EXCELLENT TRANSPARENCY USING THE COMPOSITION

TECHNICAL FIELD

The present invention relates to a composition for coating an organic electrode and method of manufacturing an organic electrode having an excellent transparency using the composition, and more particularly to a method of manufacturing an organic electrode having an excellent transparency comprising steps of mixing a aqueous solution of polyethylenedioxythiophene (PEDOT) conductive polymers having nano-sized particle, polyhydric alcohol, polyol or a mixed solvent thereof, microphase-separating conductive polymers particle having a nano-sized from the aqueous solution of conductive polymers, wherein a visible ray transmittance of an organic conductive layer is more than 90% in case of coating and wherein a sheet resistance of layer is 300 to 900 Ω/sq.

As computer, various household appliances and telecommunication device are digitalized and are rapidly highly effected, the embodiment of large layer and portable display have been necessarily needed. In order to embody a large portable flexible display, a display material which is possible to fold or roll such a newspaper has been needed.

To achieve the large portable flexible display, an electrode material using for display is transparent, and also shows a low resistance and high intensity so as to mechanically stabilized when being bent or folded. Further the electrode material should have a coefficient of thermal expansion similar to coefficient of thermal expansion of a plastic substrate so that a short circuit or large change of a sheet resistance should not occur in case of being overheated or in a high temperature.

It is possible to manufacture a display having any form by means of using a flexible display, therefore can be made the best use of clothes which can be changed a color or a pattern, trademark of clothes, billboard, price guidebook of commodity stand or a large area electrical light device as well as the portable display device.

BACKGROUND ART

Presently, a study has been progressed about study about a chemical vapor deposition using a various metallic oxide of Indium, Tin, Zinc, Titanium and Cesium, magneton sputtering and a reactive evaporation as a method for preparing transparent electrode at home and abroad. But the study has a demerit resulting in high process cost in order to coat to a metal oxide on the substrate because coating metallic oxide to substrate needs to vacuum condition.

As a method for preparing transparent electrode processed at lower cost, a method for using conductive polymers has been become influential. The electrode processed by using conductive polymers is good for decreasing the process cost and working process because it is capable of using a various existing method for a coating polymer.

In case of manufacturing a flexible display or a electrical light device, when the transparent electrode processed with the conductive polymers such a polyacethylene, polypyrrole, polyaniline and polythiophene is compared with the transparent electrode processed with a Indium Tin Oxide (ITO), it takes advantage of the process, and in case of need for a very flexible electrode, particularly manufacture of touch screen, the transparent electrode processed with the conductive polymers is good for increasing a life time. The transparent electrode have many merits, but generally conductive polymers increases a sheet resistance in case of slightly coating layer in order to increase the transmittance so that conductive polymers absorb a ray in the visible rays area and the conductive feature of organic electrode manufactured by the conductive polymers is increased in proportional to the thickness of the electrode. Therefore the conductive polymers is difficulty in applying to a applicable field of the transparent electrode such a touch panel, flexible display. Particularly in order to improve the process of the conductive polymers, when the transparent electrode is manufactured with the method, wherein the conductive polymers is pulverized to the nano-sized particle and uses commercially available dispersed polythiophene, it shows about 1□/sq of sheet resistance. Therefore it is difficulty in using with the transparent electrode using for displaying in the condition of 85% of transmittance.

U.S. Pat. No. 5,766,515, U.S. Pat. No. 6,083,635 and Korean Patent Publication NO. 2000-1824 disclose a method for improving the conductivity of electrode manufactured with the aqueous solution of polyethylenedioxythiophene (PEDOT) conductive polymers having nano-sized particle by using a solvent or a additive. But U.S. Pat. No. 5,766,515 or U.S. Pat. No. 6,083,635 has a problem as following, when a polyhydric alcohol, e.g sorbitol is added, the sheet resistance of coating layer having more than 90% transmittance is difficult to decrease less than 1 □/sq, and when a amide solvent is added, the sheet resistance of coating layer can be decrease less than 1 □/sq, but a hardness of layer is low and coating feature is diminished. On the other hand, according to Korean Patent Publication NO. 2000-1824, when a silicasol is added to aqueous solution of polythiopene treated with the amide solvent, the hardness of layer is improved, and the sheet resistance is increased more than 1 □/sq in case of improving the hardness of layer.

To consider above the feature, the coating layer shows more than 90% of the transmittance and less than several hundred Ω/sq of the sheet resistance, also has the excellent transparency and hardness and the low resistance. Therefore a development of organic transparency electrode material which can apply to a electronic equipment has been needed continually.

DISCLOSURE OF INVENTION

Technical Problem

Therefore, the present inventor has repeatedly studied a composition for coating an organic electrode for producing a organic electrode having a high transparency. Finally, the present inventors have found and completed that it makes to microphase-separate conductive polymers having nano-sized particle from a aqueous solution of conductive polymers when a aqueous solution of polyethylenedioxythiophene (PEDOT) conductive polymers having nano-sized particle, polyhydric alcohol and as a surfactant, a primary alcohol solvent and a amide solvent, a sulfoxide solvent or a mixed solvent thereof is mixed. Therefore in case of coating to the composition, the transmittance of conductive layer in the visible ray area shows more than 90% and the sheet resistance shows the range of 300 to 900 Ω/sq.

An object of the present invention is to provide the composition for coating an organic electrode which can be microphase-separated the conductive polymers of nano-sized particle.

Another object of the present invention is to provide a method for preparing high transparent organic electrode using the composition.

TECHNICAL SOLUTION

To achieve the object of present invention, the feature of a composition for coating an organic electrode according to present invention is a composition for coating an organic electrode comprising 3% to 20% by weight of a polyhydric alcohol, a polyol or a mixture thereof; 5% to 100% by weight of a primary alcohol having C1 to C5; 5% to 25% by weight of a amide, sulfoxide or a mixed solvent thereof; 0.01% to 0.1% by weight of a surfactant and an aqueous solution of polyethylene-dioxythiophene (PEDOT) conductive polymers having nano-sized particle in a remainder; and wherein a concentration of polyethylenedioxythiophene (PEDOT) and polystyrenesulfonate (PSS) solid in the aqueous solution is 1.0% to 1.5% by weight of based on the total weight of solution, wherein a visible ray transmittance of organic conductive layer is more than 90% in case of coating, wherein a sheet resistance of layer is 300 to 900 Ω/sq.

Also, the feature of the method for preparing high transparency organic electrode according to present invention is to comprise a method of preparing high transparent organic electrode comprising steps of stirring the composition, spreading out the composition on a transparent substrate, drying up the substrate and coating 0.2 to 2.0□ by thickness of coating layer.

Also, the feature of a method for preparing high transparency organic electrode according to present invention is to comprise steps of stirring the composition, repeatedly dispersing the composition 2 to 10 times per 3 to 10 minutes with a ultra sonicator controlled by 20,000 to 40,000□ of frequency, 50 to 700 W of power, spreading out the dispersed solution on the transparent substrate, drying up the substrate and coating 0.2 to 20□ by thickness of coating layer.

BEST MODE FOR CARRYING OUT THE INVENTION

Following, a composition for coating an organic electrode according to the present invention is detailedly described.

A composition for coating an organic electrode according to present invention is comprising: as a essential constituent, an aqueous solution of polyethylenedioxythiophene (PEDOT) conductive polymers having nano-sized particle; a polyhydric alcohol, polyol or a mixture thereof; a primary alcohol having C1 to C5; a amide, sulfoxide or a mixed solvent thereof and a surfactant, and further comprising a dopant containing a crossing-linking agent or a sulfonic acid group (—$SO_3H$).

The aqueous solution of polyethylenedioxythiophene (PEDOT) conductive polymers having nano-sized particle is dispersed some 5 repeating unit of a ethylenedioxythiophene oligomer into a polystyrenesulfonate (PSS) gel, wherein a concentration of the polyethylenedioxythiophene (PEDOT) and the polystyrenesulfonate (PSS) solid in aqueous solution is 1.0% to 1.5% by weight of based on the total weight of the aqueous solution, more preferably 0.4% to 0.7% by weight of the polyethylenedioxythiophene, 0.6% to 0.8% by weight of the polystyrenesulfonate (PSS). For example, as a aqueous solution of polyethylenedioxythiophene (PEDOT) conductive polymers having nano-sized particle, Baytron P (bayer Co., Ltd) can be used in the present invention. On the other hand, the conductivity is not belong to the range of 300 to 900 Ω/sq, when the aqueous solution of conductive polymers is less than 40% by weight of the composition for coating the organic electrode.

The transmittance of the visible ray areas is decreased less than 85% when the aqueous solution of conductive polymers is more than 70% by weight of a composition for coating organic electrode. Therefore, it is preferred that the conductive polymers do not belong to the range.

The polyhydric alcohol, polyol or the mixture thereof from among the constituent needs a affinity which is possible to mix with the nano particle of the conductive polymers in the metastable condition, simultaneously the function which is increased the conductivity among ethylenedioxythiophene by improving a cohesive force between the conductive nano particle by interaction with the polystyrenesulfonate (PSS) and the function which is improving the transmittance of the film by forming the empty space linked to each other conductive nano particle by the microphase-separation.

In order to improve a adhesive strength of each other particle, the polyhydric alcohol, polyol or the mixture thereof from among the constituent should contain more than two of hydroxy group (—OH). In order to simultaneously perform the adhesive strength between the conductive nano particle and the improvement of transmittance by microphase-separation, a molecule weight of polyhydric alcohol is preferable to less than 300. In case of more than 300 m.w of polyhydric alcohol, a distance between the conductive nano particle become more distance, therefore the conductivity may be decreased. The example of usable alcohol is a ethyleneglycol, propylenegylcol, butanediol, neopentylgylcol, diethylenegylcol, triethylenegylcol, methylpentanediol, hexanediol, trimethylolpropane, glycerine, ethylhexanediol, hexanetriol, polyethyleneglycol, polypropyleneglycol, polyoxypropyleneglycol, polytetramethyleneglycol, sorbitol and a derivative thereof, more preferably a ethyleneglycol, diethylenegylcol or glycerine of less than 150 m.w. A improvement of conductivity by the additive and the hardness of layer is not effective when the polyhyric alcohol or polyol is less than 3% by weight. The conductivity is lowered by relatively decreasing the weight of nano particle of conductivity polymer when the polyhyric alcohol or the polyol is less than 20% by weight. Therefore, the polyhydric alcohol, polyol or the mixture thereof is preferable to use 3% to 20% by weight of based on the total weight of the composition for coating organic electrode.

On the other hand, the amide solvent and sulfoxide solvent from among the constituent of the present invention easily make to swell a gel to be superior to the affinity with the polystyrenesulfonate (PSS) as a dopant forming nano particle gel of conductive polymers. The conductive nano particle is formed a bend and is easy to percolate between dispersed ethylenedioxythiophene oligomer by means of interactive diffusion of a chain of polymers between swelling gel, therefore the conductivity is improved. For example, as a amide solvent, a formamide, N-methylformamide, N,N-dimethylformamide, acetamide, N-methylacetamide, N,N-dimethylacetamide, N-methylpropionamide, 2-pyrrolidone, N-methylpyrrolidone, caprolactam and a 1,1,3,3-tetramethylurea can be used. Also as a sulfoxide solvent, a methylsulfoxide, dimethylsulfoxide, sulfolane and a diphenylsulfone can be used. When the amide, sulfoxide or the mixed solvent thereof is less than 5% by weight, a effect of added solvent is weak, therefore the transparency electrode having 300 to 900 Ω/sq of sheet resistance and 90% of the transmittance can not be manufactured. A gelatinization is progressed in solution or ununiform film is manufactured, when the amide, sulfoxide or the mixed solvent thereof is more than 25% by weight. Therefore the amide, sulfoxide or the mixed solvent thereof is preferable to use 5% to 25% by weight based on the total weight of a composition for coating the organic electrode.

Besides, the surfactant and primary alcohol having C1 to C5 are bad for wetting feature when the transparent polymer substrate such a polyethyleneterepthalate which have a high surface free energy is coated with the amide, sulfoxide or the mixed solvent thereof. Therefore it is capable of solving the problem to easily form the ununiform layer.

To consider the affinity with the solution, as a primary alcohol, alcohol having C1 to C5 can be used, more preferably isopropanol, ethanol and a methanol is used. When the primary alcohol is less than 5% by weight, it is bad for wetting feature. When the primary alcohol is more than 10% by weight, it is bad for the conductivity. Therefore, it is preferable to use 5% to 10% by weight based on the total weight of the composition for coating the organic electrode.

On the other hand, the surfactant is preferable to be selected at least one of surfactants from the group consisting of a nonioic surfactant, anionic surfactant, cationic surfactant and a neutral surfactant and ELB (hydrophilic-lipophilic balance) is within 7 to 20. As a nonionic surfactant, a polyoxyalkylene alkyl ether containing a polyoxyethylene lauryl ether and a polyoxyethylene stearyl ether, a polyoxyalkylene alkylphenyl ester containing a polyoxyethylene octylphenyl ether and a polyoxyethylene nonylphenyl ether, a sorbitan fatty acid ester containing a sorbitan monolaurate, a sorbitan monostearate and a sorbitan trioleate, a polyoxyalkylene sorbitan fatty acid ester containing a polyoxyethylene sorbitan monolaurate, a polyoxyalkylene fatty acid ester containing a polyethylene monolaurate and a polyoxyethylene monostearate, a glycerine fatty acid ester containing a olenic acid monoglyceride and a stearic acid monoglycerate and a polyoxyethylene-polypropylene block copolymers can be used.

As a anionic surfactant, a fatty acid sodium containing a sodium stearate, sodium oleate and a sodium laurate, a alkylaryl sulfonic acid sodium containing a sodium dodecylbezenesulfonate, a alkylsulphuric acid ester sodium containing a sodium laurylsulfate, a alkylsulfosuccinic acid ester sodium containing a sodium monooctylsulfosuccinic acid, sodium dioctylsulfosuccinate and a sodium polyoxyethylene laurylsulfosuccinate, polyoxyalkylene alkylether sulphuricacidestersodium containing a sodium polyoxyethylenelauryl ethersulfate and a polyoxyalkylene alkylarylether sulphuricacid ester sodium containing a sodium polyoxyethylene nonylphenyl ether sulfate can be used. As a cationic surfactant and neutral surfactant, a alkyl amine sodium containing a lauryl amine acetate, a 4-level ammonium sodium containing a lauryltrimethylammonium chloride and a alkylbenzyldimethylammonium chloride and a polyoxyethylalkyl-amine can be used. More preferably as a nonionc surfactant, a polyoxyethylene surfactant having a excellent wetting feature is used. When the surfactant is less than 0.01% by weight, the form of film is ununiform so that the wetting feature is bad. When the surfactant is more than 0.1% by weight, the surfactant and the nano particle of conductive polymers is phase-separated thereby can be formed non-transparant layer. Therefore the surfactant is preferable to use 0.01% to 0.1% by weight of based on the total weight of the composition for coating the organic electrode.

In case of coating to the composition comprised with the composite, the hardness of the layer of organic conductivity is good, as 3H of pencil hardness tester, but the composition can further comprise the cross-linking agent in order to improve the hardness of layer. As the cross-linking agent which is combining acid group of polystyrenesulfonate (PSS) with hydroxy group of polyhydric alcohol or polyol or is capable of inducing the link with each hydroxy group of the polyhydric alcohol and the polyol, a 4,4-diphenylmethane diisocyanate, toluene diisocyanate, hexamethylene diisocyanate and a organic titanium compound (Vertic IA10, Johnson Mattey Catalysts) can be used. When the cross-linking agent is less than 0.01% by weight, the cross-linking is not sufficient and the improvement of the hardness of layer is inadequate. When the cross-linking agent is more than 0.2% by weight, it is difficulty in forming the uniform layer and bad for stability of solution in the long time, because the cross-linking agent is tend to gelatinize in mixed solution. Therefore the cross-linking agent is preferably added to use 0.01% to 0.2% by weight of based on the total weight of the composition for coating the organic electrode.

The conductivity of layer feature can be improved by adding a monomer coating a sulfonic acid group (—$SO_3H$) as a further dopant to the conductive layer composed the composition. As a dopant, a polystyrene sulfonic acid, p-toluene sulfonic acid, dodecylbenzensulfonic acid, 1,5-anthraquinone disulfonic acid, 2,6-anthraquinone disulfonic acid, anthraquinone disulfonic acid, 4-hydroxybenzensulfonic acid, methylsulfonic acid or a nitrobenzensulfonic acid can be used. When the dopant is less than 0.01% by weight, a dopping effect is decreased. When the dopant is more than 0.5% by weight, the uniformity of the layer is decreased so that added monomer dopant is phase-separated. Therefore, when the dopant is added, the dopant is preferable to use 0.01% to 0.5% by weight to based on the total weight of the composition for coating the organic electrode.

Following, a method of manufacturing organic electrode having excellent transparency using the composition is described in more detail.

A method of manufacturing organic electrode having excellent transparency according to the present invention comprises steps of stirring the composition for coating the organic electrode, spreading out the stirred composition on the transparent substrate, drying up the substrate and coating to 0.2 to 20□ by thickness of coating layer. But according to usage, further comprises steps of repeatedly dispersing the stirred composition 2 times to 10 times for 3 to 10 minutes with the ultra sonicator controlled by 20.000 to 40.000□ of frequency, 50 to 700 W of power after the step for stirring.

First, the composition for coating the organic electrode is manufactured by a order which is slowly stirring the aqueous solution of polyethylene-dioxythiophene conductive polymers, at the same time adding orderly the polyhydric alcohol or the polyol, the primary alcohol, amide solvent or the sulfoxide solvent, surfactant, cross-linking agent, dopant and then stirring sufficiently at room temperature for 1 to 2 time.

In case of manufacturing method using the ultra sonicator, the step of repeatedly dispersed the composition for 3 to 10 minutes with the ultra sonicator controlled by 20,000 to 40,000□ of frequency, 50 to 700 W of power is repeated at 2 times to 10 times, so the swelling of conductive nano particle gel is increased by the step. Following, the dispersed solution is spreaded out on the transparent substrate, e.g polyester film, dried up the substrate at heating, so coating layer is formed, the thickness of the coating layer is 0.2 to 20□, more preferably 0.5 to 10□. As a transparent substrate, a glass, cellulose ester, polyamide, polycarbonate, polyester, polystyrene, polylolefin, polymetha acrylate, polysulfone, polyethersulfone, polyetherketone, polyetherimide and a polyoxyethylene can be used and more preferably a triacetyl cellulose, polycarbonate or a polyethylene terephthalate is used.

The visible ray transmittance of conductive layer of organic electrode manufactured by the step is more than 90%, the conductivity is generally 300 to 900 Ω/sq, more preferably less than 500 Ω/sq and the hardness of layer is the range of 2H to 4H. The transparent organic electrode can be manufactured by means of the method.

To use the method for manufacturing transparency organic electrode, the organic transparency electrode using for various display can be variously manufactured. Also, the organic electrode of the present invention is widely capable of applying to a various field, e.g a electrode or wiring material of organic transistor, smart card, antenna, electrode of battery and fuel battery, capacitor using for PCB or inductor, closing film of electronic wave, preventing film of static electricity generation and a sensor as well as the transparent electrode using for display.

MODE FOR THE INVENTION

The present invention will be described in more detail by way of the following examples, comparative examples, preparative example and example of comparative preparation. However the present invention should not be limited the examples, comparative examples, preparative example and example of comparative preparation.

EXAMPLE 1~8

TABLE 1

| | | Example(Unit: % by weight) | | | | | | | |
|---|---|---|---|---|---|---|---|---|---|
| | | 1 | 2 | 3 | 4 | 5 | 6 | 7 | 8 |
| Conductive polymers aqueous solution | Baytron P(PEDOT) | remainder | remainder | remainder | remainder | remainder | remainder | remainder | remainder |
| Polyhydic alcohol or polyol | Ethyleneglycol(EG) | 13 | 15 | 13 | 13 | 10 | 13 | 13 | 13 |
| | Diethyleneglycol(DEG) | — | — | — | — | 10 | — | — | — |
| Primary alcohol | Isopropaneol(IPA) | 7 | 9 | 7 | 7 | 7 | 7 | 7 | 7 |
| Amide solvent | Methylformamide(MF) | 2 | 2 | 2 | 2 | 2 | 15 | 2 | 2 |
| | Dimethylformamide(DMF) | — | — | — | 13 | — | — | — | — |
| | N-Methylpyrrolidone(NMP) | — | — | 13 | — | — | — | — | — |
| Sulfoxide solvent | Dimethylsulfoxide(DMSO) | 13 | 13 | — | — | — | — | 13 | 13 |
| Surfactant | Triton X-100 | 0.06 | 0.06 | 0.06 | 0.06 | 0.06 | 0.06 | 0.06 | 0.06 |
| Dopant | p-toluenesulfonic acid | — | — | — | — | — | — | 0.1 | — |
| | Dodecylbenznesulfonic acid | — | — | — | — | — | — | — | 0.1 |

—Preparation—

As a aqueous solution of polyethylenedioxythiophene (PEDOT) conductive polymers, Baytron P (polyethylene-dioxythiophene; Bayer AG. the location:Leverkusen, Germany) was bottled in a beaker in an amount of the Table 1, and the Baytron P is stirred. As a amide solvent, a methylformamide (Aldrich, the location of Wisconsin, US), dimethylformamide (Aldrich, the location of Wisconsin, US), or a N-methylpyrrolidone (Aldrich, the location of Wisconsin, US); as a sulfoxide solvent, a dimethylsulfoxide (Aldrich, the location of Milwaukee Wis., US); as a polyhydric alcohol or polyol, a ethyleneglycol (Aldrich, the location of Milwaukee Wis., US), a diethylene glycol (Aldrich, the location of Milwaukee Wis., US); as a primary alcohol, a isopropaneol (Aldrich, the location of Milwaukee Wis., US); as a surfactant, a Trion X-100 (manufactured by Union carbide); and as a dopant, a p-tolenesulfonic acid (Aldrich, the location of Milwaukee Wis., US) or a dodecylbenzensulfonic acid (Aldrich, the location of Milwaukee Wis., US) in an amount of the table 1 were added into the stirred solution of the Batyron P, therefore the composition for forming film was produced.

COMPARATIVE EXAMPLE 1~7

TABLE 2

| | | Comparative example(Unit: % by weight) | | | | | | |
|---|---|---|---|---|---|---|---|---|
| | | 1 | 2 | 3 | 4 | 5 | 6 | 7 |
| Conductive polymers aqueous solution | Baytron P(PEDOT) | 100 | remainder | remainder | remainder | remainder | remainder | remainder |
| Polyhydric alcohol or polyol | Ethyleneglycol(EG) | — | — | — | — | — | 14 | 16 |
| | Diethyleneglycol(DEG) | — | — | — | 10 | — | — | — |
| Primary alcohol | Isopropaneol(IPA) | — | — | — | — | 33 | 17 | 4 |
| Amide solvent | Methylformamide(MF) | — | — | 3 | — | 2 | — | 2 |
| Surfactant | Triton X-100 | — | 0.06 | — | — | — | — | — |

—Preparation—

With the exception of the addition in an amount of the table 2, the composition for forming film is produced by the same method with the examples 1~8.

PREPARATIVE EXAMPLE 1~8

The composition of the example 1 was stirred by 300 rpm for 1 time, spreaded out the stirred composition on the polyester film using a Ba coater, and dried up the film at 100° C. dryer for 30 minutes, therefore the organic transparent electrode having the form of the transparent substrate and the thickness of coating layer was produced.

EXAMPLE 1 OF COMPARATIVE PREPARATION

As the comparative example 1, the Baytron P was spin-coated on the glass substrate by 300 rpm for 30 seconds, dried up the substrate at 110° C. dryer for 30 minutes, therefore the organic transparent electrode having the form of the transparent substrate and 400□ by thickness of coating layer was produced.

EXAMPLE 2 OF COMPARATIVE PREPARATION

With the exception of further addition of a Tritron X-100, the organic transparent electrode was produced by means of the same method with the method of the example 1 of comparative preparation.

EXAMPLE 3~7 OF COMPARATIVE PREPARATION

With the exception of the usage of the composition produced by the comparative example 3~7 instead of the example 1 of comparative preparation, the organic transparent electrode was produced by means of the same method with method of the example 1 of comparative preparation.

EXPERIMENTAL EXAMPLE 1

To use the transparent electrode produced by the preparative example 1~8, the conductivity, transmittance, and the hardness of layer were measured. The conductivity was measured by the sheet resistance with a sheet resistor (Loreasta-GP MCP-T600, Mitsubishi chemical Co.), the transmittance was measured by 550□ transmittance with a UV-vis spectrometer (Helios β, Spectronic Unicam Co.) and the hardness of layer was measured with a pencil hardness tester, therefore the result by the measurement was shown under the table 3.

TABLE 3

| | Preparative example | | | | | | | |
|---|---|---|---|---|---|---|---|---|
| | 1 | 2 | 3 | 4 | 5 | 6 | 7 | 8 |
| Conductivity(Ω/sq) | 500 | 600 | 750 | 700 | 850 | 800 | 400 | 800 |
| Transmittance(%) | 93 | 90 | 86 | 88 | 86 | 88 | 93 | 92 |
| Hardness of layer | 3H | 3H | 3H | 3H | 3H | 3H | 3H | 3H |

As shown in the above table 3, all the transparent electrode produced by the preparation example 1~8 indicated excellence that the conductivity (sheet resistance of layer) is within 300 to 900 Ω/sq, the transmittance of visible ray area is approximate to 90% and the hardness of layer is within 2H to 4H.

EXPERIMENTAL EXAMPLE 2

To use the example 1~7 of comparative preparation instead of the preparative example 1~8, the conductivity, transmittance, and the hardness of layer were measured, therefore the result by the measurement was shown under the table 4.

TABLE 4

| | Example of comparative preparation | | | | | | |
|---|---|---|---|---|---|---|---|
| | 1 | 2 | 3 | 4 | 5 | 6 | 7 |
| Conductivity(Ω/sq) | $10^6$ | $8 \times 10^5$ | 600 | 900 | 700 | 700 | 800 |
| Transmittance(%) | 85 | 85 | 70 | 87 | 84 | 83 | 82 |
| Hardness of layer | 2B | 2B | 1B | 1H | 1B | 2H | 2H |

As shown in the above table 4, in the example of comparative preparation 3 and 7, when an amount of aqueous solution of polyethylenedioxythiophene (PEDOT) conductive polymers was more than 90%, the transmittance is not sufficient more than 90%. In the example 1~3 and 5 of comparative preparation, when the polyhydric alcohol was not used, the hardness of layer was decreased and the layer was not uniform.

PREPARATIVE EXAMPLE 9

The composition of the example 1 was stirred by 300 rpm for 1 times, and dispersed the stirred composition with the ultra sonicator controlled by 2,000□ and 140 W, 5 times for 3 minutes. The dispersed solution was spreaded out on the polyester film with the Barcorder, dried up the film with 110° C. dryer for 30 minute, therefore the organic transparent electrode having a 2□ by thickness of coating layer was produced.

EXAMPLE 8 OF COMPARATIVE PREPARATION

With the exception of dispersion produced by the preparative example 1, wherein mixture was dispersed by 140 W of the ultra sonicator for 10 seconds, therefore the transparent electrode was produced with same method.

EXAMPLE 9 OF COMPARATIVE PREPARATION

With the exception of the produced dispersion by the preparative example 9, wherein mixture was dispersed by 1,000 W of the ultra sonicator for 3 minutes, the transparent electrode was produced with same method.

EXPERIMENTAL EXAMPLE 3

According to measuring method of the experimental example 1, the conductivity, transmittance and the hardness of layer of the preparative example 9 and the example 8 and 9 of comparative preparation were measured.

TABLE 5

| | Preparative example 9 | Example of-comparative preparation 8 | Example of-comparative preparation 9 |
|---|---|---|---|
| Conductivity(Ω/sq) | 450 | 600 | $10^4$ |
| Transmittance(%) | 90 | 95 | 88 |
| Hardness of layer | 3H | 3H | 3H |

As shown in the above table 5, when the preparative example 9 was controlled that the power of the ultra sonicator is the range of 50 W to 700 W, the dispersion time is 3 to 10 minutes. Therefore the transmittance of visible ray was excellent as 90% and more preferably the conductivity showed 450 Ω/sq.

INDUSTRIAL APPLICABILITY

From the above detailed description, a composition for coating an organic electrode and method of manufacturing an organic electrode having an excellent transparency using the composition according to a present invention are capable of producing a flexible transparent organic electrode of large dimension which is excellent to a conductivity and transmittance through steps for coating and printing. Therefore the present invention are capable of increasing the economical efficiency of the process rather than a metal oxide electrode using a existing vacuum process, also is widely capable of applying to a various field of a electrode or a wiring material of organic transistor, smart card, antenna, electrode of battery and fuel battery, a capacitor using for PCB or a inductor, closure of electronic wave and a sensor etc. as well as the transparency electrode using for display.

The invention claimed is:

1. A composition for coating organic conductive layer comprising: 3% to 20% by weight of a polyhydric alcohol, a polyol or a mixture thereof; 5% to 10% by weight of a primary alcohol having C1 to C5; 5% to 25% by weight of a mixed solvent of an amide and a sulfoxide; 0.01% to 0.1% by weight of a surfactant and aqueous solution of polyethylenedioxythiophene (PEDOT) conductive polymers aqueously dispersed with nano-sized particles when polyethylenedioxythiophene (PEDOT) conductive polymers become nano-sized particles in a remainder; and wherein a concentration of polyethylenedioxythiophene (PEDOT) and polystyrenesulfonate (PSS) solid in the aqueous solution is 1.0% to 1.5% by weight of based on the total weight of solution, wherein a visible ray transmittance of the organic conductive layer is more than 90% in case of coating, wherein a sheet resistance of the organic conductive layer is 300 to 900 Ω/sq.

2. The composition of claim 1, wherein said polyhydric alcohol, the polyol or the mixture thereof is at least one of alcohols selected from the group consisting of a ethyleneglycol, propyleneglycol, butanediol, neopentyiglycol, diethyleneglycol, triethyleneglycol, methylpentanediol, hexanediol, trimethylolpropane, glycerine, ethylhexanediol, hexanetriol, polyethyleneglycol, polypropylenegylcol, poly oxypropylenetriol, polytetramethyleneglycol, sorbitol, and thereof a derivative.

3. The composition of claim 2, wherein said molecular weight of polyhydric alcohol or polyol is less than 300.

4. The composition of claim 1, wherein said amide solution is at least one of solvents selected from the group consisting of a formamide, N methylformamide, N, N-dimethylformamide, aceteamide, N-methylaceteamide, N,N-dimethylaceteamide, N-methylpropionamide, pyrrolidone, N-methylpyrrolidone, caprolactam and a tetramethylurea, and wherein said sulfoxide solvent is at least one of solvents selected from the group consisting of a methylsulfoxide, dimethylsulfoxide, sulfolane and a dimethylsulfone.

5. The composition of claim 1, wherein said surfactant is at least one of surfactants selected from the group consisting of a nonionic surfactant, anionic surfactant, cationic surfactant and a neutral surfactant, and a HLB(hydrophilic-lipophilic balance) is within 7 to 20.

6. The composition of claim 1, wherein said composition further comprising of 0.01% to 0.5% by weight of a compound, containing a sulfonic acid as a dopant.

7. The composition of claim 6, wherein said dopant is at least one of compounds selected from the group consisting of a polystyrenesulfonic acid, p-toluenesulfonic acid, dodecylbenzenesulfonic acid, anthraquinonesulfonic acid, 4-hydroxybenzenesulfonic acid, methylsulfonic acid and a nitrobenzenesulfonic acid.

8. A method of manufacturing an organic conductive layer having excellent transparency comprising: stirring said composition of claim 1; spreading out said composition on a transparent substrate; drying up the substrate; and coating 0.2 to 20 μm by thickness of coating layer.

9. A method of manufacturing an organic conductive layer having excellent transparency comprising steps of: stirring said composition of claim 1; repeatedly dispersing said composition 2 to 10 times per 3 to 10 minutes with a ultra sonicator controlled by 20,000 to 40,000 Hz of frequency, 50 to 700 W of power; spreading out said dispersed solution on a transparent substrate; drying up the substrate; and coating 0.2 to 20 μm by thickness of coating layer.

* * * * *